United States Patent [19]

Feldman et al.

[11] 4,014,663

[45] Mar. 29, 1977

[54] SYNERGISTIC LOW TEMPERATURE FLOW IMPROVER IN DISTILLATE FUEL

[75] Inventors: Nicholas Feldman, Woodbridge; Arthur W. Langer, Jr., Watchung, both of N.J.

[73] Assignee: Exxon Research and Engineering Company, Linden, N.J.

[22] Filed: Nov. 28, 1975

[21] Appl. No.: 635,846

Related U.S. Application Data

[63] Continuation-in-part of Ser. No. 517,162, Oct. 23, 1974, abandoned, which is a continuation of Ser. No. 427,802, Dec. 26, 1973, abandoned.

[52] U.S. Cl. ..... 44/71; 44/62; 44/78; 44/80

[51] Int. Cl.[2] ..... C10L 1/22

[58] Field of Search ..... 44/62, 71, 78, 80

[56] References Cited

UNITED STATES PATENTS

| | | | |
|---|---|---|---|
| 2,384,107 | 9/1945 | Lieber | 252/59 |
| 3,444,082 | 5/1969 | Kautsky | 44/62 |
| 3,544,467 | 12/1970 | Kautsky | 44/71 |
| 3,846,093 | 11/1974 | Feldman | 44/80 |
| 3,910,776 | 10/1975 | Feldman | 44/62 |

*Primary Examiner*—Allen B. Curtis
*Assistant Examiner*—Mrs. Y. Harris-Smith
*Attorney, Agent, or Firm*—Byron O. Dimmick

[57] ABSTRACT

The low temperature filterability of a petroleum middle distillate fuel, such as a heating oil or a diesel fuel is improved by adding to the fuel a synergistic combination of an N-aliphatic hydrocarbyl succinamic acid or derivative thereof with a dimer of an alpha olefin, with a polymer of such dimer, or with an alkylated aromatic compound such as an alkylated diphenyl or an alkylated diphenyl ether. The olefin dimers are of alpha olefins of from 16 to 40 carbon atoms. The alkyl groups on the alkylated aromatics are derived from $C_{16}$-$C_{50}$ olefins or from dimers of $C_{16}$-$C_{40}$ alpha-olefins. This invention is particularly advantageous in improviing the flow of a diesel fuel through a fine filter at low temperatures.

14 Claims, No Drawings

SYNERGISTIC LOW TEMPERATURE FLOW IMPROVER IN DISTILLATE FUEL

CROSS-REFERENCE TO RELATED APPLICATIONS

This application is a continuation-in-part of application Ser. No. 517,162, filed Oct. 23, 1974, now abandoned which in turn is a continuation of application Ser. No. 427,802, filed Dec. 26, 1973, now abandoned.

This invention relates to the use of a synergistic combination of additives for improving the low temperature flow properties of a petroleum middle distillate fuel.

Heating oils and other middle distillate petroleum fuels, e.g., diesel fuels, contain normal paraffin hydrocarbon waxes which, at low temperatures, tend to precipitate in large crystals in such a way as to set up a gel structure which causes the fuel to lose its fluidity thereby presenting difficulties in transporting the fuel through flow lines and pumps. The wax crystals that have come out of solution also tend to plug fuel lines, screens and filters. This problem has been well recognized in the past and various additives known as pour point depressants have been used to change the nature of the crystals that precipitate from the fuel oil, thereby reducing the tendency of the wax crystals to set into a gel. It is thus desirable to obtain not only fuel oils with low pour points, but also oils that will form small wax crystals so that the clogging of filters will not impair the flow of the fuel at low operating temperatures.

DESCRIPTION OF THE PRIOR ART

It is known in the prior art to employ various polymeric and copolymeric materials as pour point depressants for wax-containing petroleum fractions.

Among these are included copolymers of ethylene with other monomers, e.g., copolymers of ethylene and vinyl esters of lower fatty acids such as vinyl acetate; terpolymers of ethylene, vinyl esters and alkyl fumarates; terpolymers of ethylene, vinyl esters and higher olefins; and copolymers of ethylene and other olefins. The use of an alkenyl succinamic acid that is disubstituted on the nitrogen atom, or of the amine salts of such acids, and the use of such acids or their salts in combination with a low molecular weight ethyleneolefin copolymer are taught in U.S. Pat. No. 3,444,082 of G. J. Kautsky, granted May 13, 1969.

DESCRIPTION OF THE INVENTION

In accordance with the present invention, the low temperature filterability properties of a middle distillate fuel, such as a heating oil or diesel fuel, are improved by incorporating into a major amount of a distillate fuel, a minor flow improving amount of (A) a synergistic combination of an N-aliphatic hydrocarbyl succinamic acid or derivative thereof and (B) a derivative of an alpha olefin selected from the group consisting of dimers of alpha olefins of from 16 to 40 carbon atoms, polymers of such dimers, and aromatic compounds alkylated with $C_{16}$ to $C_{50}$ olefins or alkylated with dimers of $C_{16}$ to $C_{40}$ alpha olefins. Generally, the related weight ratios will be from about 0.01 to 10, preferably 0.15 to 1.5 parts by weight of (B) per part by weight of (A). Generally there will be added to a waxy middle distillate petroleum fuel from about 0.01 to about 3 weight percent, or more preferably from about 0.05 to about 0.75 weight percent of the additive combination of the invention. Concentrates of the additive combination can also be prepared containing from 3 to 60 weight percent of the combination in a hydrocarbon oil, as for example, a distillate fuel.

The distillate fuel oils that can be improved by this invention include those having atmospheric boiling ranges within the limits of about 250° F. to about 750° F. and cloud points ranging from about −20° F. to about 25° F. in most instances. The distillate fuel oil can comprise straight run or virgin gas oil or cracked gas oil or a blend in any proportion of straight run and termaly and/or catalytically cracked distillates.

The most common petroleum middle distillate fuels are kerosene, diesel fuels, jet fuels and heating oils. The low temperature flow problem is most usually encountered with diesel fuel and with heating oils. A representative heating oil specification calls for a 10% distillation point no higher than about 440° F., and 90% point of at least 540° F. and no higher than about 640° F. to 650° F., although some specifications set the 90% point as high as 675° F. See for example ASTM Designation D-396. Heating oils are preferably made of a blend of virgin distillate e.g., gas oil, naphtha, etc., and cracked distillates, e.g., catalytic cycle stock. This invention is particularly applicable to use with diesel fuels, which must be capable of passing through very fine filters at low temperatures. A representative specification for No. 2-D diesel fuel includes a minimum flash point of 125° F. and 90% distillation point between 540° F. and 640° F. (See ASTM Designation D-975)

In the synergistic combination of additives, component A is an aliphatic hydrocarbyl succinamic acid or a derivative thereof. The hydrocarbyl succinamic acid can for the most part be represented by the following formula:

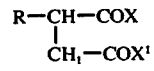

wherein R is a straight chain aliphatic hydrocarbon group having either 0 or 1 site of olefinic unsaturation (alkyl or alkenyl) attached at a secondary carbon atom to the succinyl group and is of at least 14 carbon atoms, generally in the range of 15 to 40 carbon atoms and more usually in the range of 15 to 30 carbon atoms. One of X and $X^1$ is hydroxyl and th other is:

$$-NYY^1$$

wherein N has its normal meaning of nitrogen, and Y and $Y^1$ are aliphatic hydrocarbyl groups of from 14 to 40 carbon atoms, more usually of from 15 to 30 carbon atoms, the total of Y plus $y^1$ being from about 30 to 52 carbon atoms, more usually from 32 to 48 carbon atoms, and preferably, from 32 to 40 carbon atoms. Particularly useful is a hydrocarbyl succinamic acid in which the $-NYY^1$ group is derived from di (hydrogenated tallow) amine ($C_{16}$–$C_{18}$) or from di (behenyl-arachidyl) amine ($C_{22}$–$C_{24}$) or from mixtures of those amines.

Y and $Y^1$ can be aliphatically saturated or aliphatically unsaturated, generally free of acetylenic unsaturation (i.e., either alkyl or alkenyl). There can be from 1 to 2 sites of olefinic unsaturation. Y and $Y^1$ may be the same or different and may be straight chain or branched chain, preferably straight chain. The branches will normally be not greater than 1 carbon atoms, i.e., methyl. The position of attachment to nitrogen can be at a terminal or an an internal carbon atom.

As is evidenced from the above formula, it is not important which position the alkyl or alkenyl group has in relation to the carboxamide or carboxyl group. Because of the bulky nature of the amine, the usual method of prepartion through the succinic anhydride will provide a alkenyl group beta to the carboxamide as the major product. To the extent that this is the more easily accessible derivative, this derivative is preferred. However, as far as operability is concerned, either isomer or a mixture of the two isomers can be used. Individual compounds or mixtures of compounds may be used. Mixtures of different C- and/or N-substituents, both as to homologs and isomers, will frequently be employed when the individual precursors to the succinamic acid product are not readily available. Illustrative succinamic acids include: N,N-dihexadecyl hexadecylsuccinamic acid; N-hexadecyl, N-octadecyl octadecylsuccinamic acid; N,N-dihexadecenyl $C_{15-20}$ alkenylsuccinamic acid; N-hexadecenyl N-eicosenyl octadecylsuccinamic acid; and N,N-dioctadecenyl $C_{16-18}$ alkenylsuccinamic acid.

The succinamic acid may be used as its amine salt, preferably as a mixture of acid and amine salt. The acid or the amine salt or mixtures thereof can be represented by the following formula:

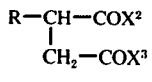

wherein R is as previously defined, and one of the $X^2$ and $X^3$ is —$NYY^1$ wherein Y and $Y^1$ are as previously defined. The other of $X^2$ and $X^3$ is of th formula:

—$OH(NHY^2Y^3)n$ wherein $Y^2$ and $Y^3$ may be hydrogen, aliphatic hydrocarbon of from 1 to 30 carbon atoms or oxaliphatic hydrocarbon of from 3 to 30 carbon atoms, there being 1 ethereal oxygen atom present in the radical bonded to nitrogen at least beta to the nitrogen atom $Y^2$ and $Y^3$ may be taken together to form a heterocyclic ring of from 5 to 7 members having nitrogen and oxygen as the only heteromembers. The value of *n* varies from 0 to 1, preferably from 0.1 to 0.9; that is, from 10 to 90 mole percent of the succinamic acid present is in the form of its salt.

The aliphatic hydrocarbon groups are preferably saturated and if unsaturated will usually have no more than 2 sites of ethylenic unsaturation. The total number of carbon atoms for $HNY^2y^3$ will be from 0 to 60, usually 1 to 40.

The groups indicated for Y and $Y^1$ may also be used for $Y^2$ and $Y^3$. Usually, where an amine other than the one used to prepare the succinamic acid is used to form the salt, as will be explained subsequently, there will a mixture of salts; both the added amine and the secondary amine employed to prepare the succinamic acid will be involved in salt formation. Primary amines may be used as well as secondary amines to form the salt. Illustrative amines that can be used to form salts include di-sec-butyl amine, heptyl amine, dodecyl amine, octadecyl amine, tert-butyl amine, morpholine, diethyl amine, methoxybutylamine, methoxyhexylamine, etc.

The hydrocarbyl succinamic acids of this invention are readily prepared by reacting an alkyl or alkenyl succinic anhydride with the desired secondary amine at a temperature in the range of about 150° to 250° F. in approximately equimolar amounts, either neat or in the presence of an inert solvent. The time for the reaction is generally in the range of 15 minutes to 1 hour. This reaction is well known in the art and does not require extensive discussion here.

The alkyl or alkenyl succinic anhydride that is used may be an individual compound or may comprise mixtures of compounds; that is, various alkyl or alkenyl groups of differing number of carbon atoms or different positions of attachment to the succinic anhydride group may be used. Alternatively, a single isomer may be used. Since mixtures are generally more readily available, to that degree they are preferred. Frequently, use will be made of mixtures of aliphatic hydrocarbyl substituted succinic anhydrides wherein no single homolog is present in amount greater than 25 mole percent, each homolog being present in at least 5 mole percent.

Various secondary amines, both those having the same aliphatic hydrocarbon groups and those having different aliphatic hydrocarbon groups, can be used in making the succinamic acid. Either alkyl or alkenyl substituents may be present on the nitrogen, each having at least 14 carbon atoms. The range of difference between the two aliphatic hydrocarbon groups bonded at the nitrogen is not critical, but will generally be fewer than 8 carbon atoms, more usually fewer than 6 carbon atoms. For the most part, the aliphatic hydrocarbon groups will be straight chain, i.e., normal, with the amino nitrogen bonded either to internal or to terminal carbon atoms.

It has been found that when using approximately a 1:1 mole ratio of amine to succinic anhydride, depending on the reaction conditions, a significant amount of amine may be unreacted and remain to form the salt of the succinamic acid that is formed. In some instances, as much as 30 percent of the amine may remain unreacted, forming a significant amount of salt. Thus, the salt will frequently be from 10 to 30 mole percent of the total succinamic acid present.

Also, in situations where significant amounts of water are present during the course of the reaction, the water may react with a succinic anhydride to form succinic acid. If the temperature is not high enough to regenerate the succinic anhydride, the succinic acid will probably remain unreacted or form the amine salt with available unreacted amine. Therefore, the mixtures of amic acid salts may be conveniently prepared merely by using a 1:1 mole ratio of amine to succinic anhydride, and not attempting to drive the reaction to completion, or up to a mole excess of amine.

The amine salts are readily prepared by adding the amine to the succinamic acid either as such or in an inert solvent. Mild heating may facilitate the reaction.

Componet B of the synergistic combination is derived from an alpha olefin and will be a dimer of an alpha olefin that has 16 to 40 carbon atoms, a polymer of such dimer, or an aromatic compound that has been alkylated with an alpha olefin having from 16 to 50 carbon atoms or with a dimer of an alpha olefin that has from 16 to 40 carbon atoms.

Dimerization of an alpha olefin is effected with an organo metallic catalyst, preferably an aluminum alkyl catalyst. The formation of olefin dimer is illustrated by the following reaction:

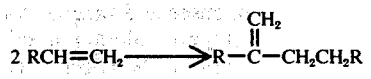

R in the above represents predominantly linear alkyl group.

The dimerization reaction can be carried out with an aluminum alkyl catalyst, preferably a trialkyl aluminum or a dialkyl aluminum hydride, and most preferably, triisobutyl aluminum or di-isobutyl aluminum hydride.

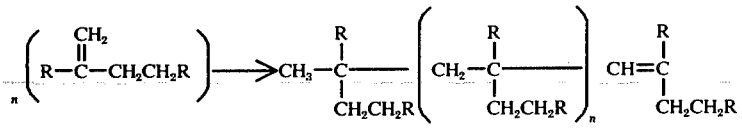

This reaction is well known in the art and has been described in various publications such as: K. Ziegler, Brennstoff Chem. 33, 193 (1952); Angew. Chem. 64 323 (1952).

A preferred dimerization can be carried out by heating the long chain alpha monoolefin with about 0.1 to 10, preferably 1 to 5 mole %, based on the moles of olefin used, of aluminum alkyl catalyst at a temperature of about 100° to 250° C., preferably 150° to 200° C., for a time of about 1 to 40, preferably 5 to 30, hours to form the dimer product.

Usually the dimerization is carried out under an inert atmosphere by blanketing the reaction with nitrogen, argon, etc. or by blowing an inert gas through the reaction mixture. After the reaction is completed, the remaining aluminum catalyst can be removed simply by dissolving the reaction product in a suitable solvent such as a light hydrocarbon, e.g., hexane, cyclohexane, benzene, etc., adding water to convert the catalyst to the hydroxide, and then filtering to remove the aluminum catalyst. Alternatively, it can be removed by filtration through clay or other adsorbents. The resulting dimer product can be used per se or it can be further purified, as for example by distillation, in order to remove any volatiles or undimerized olefin. In practical use, however, the crude dimer material itself can be used without further purification and will usually consist predominantly of dimer, together with minor amounts, e.g., less than 20 wt. %, based on said final product, of undimerized olefin.

The olefin dimers used in this invention are preferably of alpha olefins of from 16 to 34 carbon atoms; more preferably of from 18 to 24 carbon atoms.

The olefin dimers, produced as above, can be polymerized with any conventional strong acid catalyst such as Lewis acids, or protonic acids such as aluminum chloride, $BF_3$, $FeCl_3$, $TiCl_4$, $H_2SO_4$, $HClO_4$. Any conventionAL co-catalyst may be used with the Lewis acids, e.g. water, protonic acids, alkyl halides, etc. Usually, the polymerization will be carried out in a solvent such as a hydrocarbon solvent, e.g. heptane, hexane, etc. or inert polar solvents such as methylene chloride, methyl chloride, nitromethane, nitrobenzene, or mono- and polychlorobenzenes. 0.2 to 20, preferably 1 to 10, mole % of the catalyst, based on the olefin dimer, is added to the dimer dissolved in the solvent, and the reaction mixture is maintained about −50° to +100° C., preferably 0° to 50° C. for about 0.1 to 10, preferably 0.5 to 5, hours in order to form the polymer.

After the polymerization is completed the material can be purified by precipitation with alcohol, or other suitable non-solvents and washing to remove catalyst residues. Hydrocarbon soluble polymers are also easily purified by washing a hydrocarbon solution thereof, with aqueous caustic, drying the solution and stripping the hydrocarbon solvent. Polymers prepared in the forgoing manner can have molecular weights ranging from about 500 to 10,000, usually about 500 to 3,000.

The polymerization reaction can be represented by the equation:

In the above reaction, the R groups are $C_{14}$ to $C_{40}$, preferably $C_{16}$ to $C_{32}$, predominantly linear alkyl groups and $n$ is 2 to 50. Some skeletal and double bond isomers are also produced in such a reaction.

To prepare alkylated aromatic compounds for use in the present invention, the source of the alkyl groups is a predominantly linear alpha olefin of from 16 to 50 carbon atoms, preferably 20 to 30 carbon atoms or a dimer of an alpha olefin of from 16 to 40 carbon atoms, preferably of from 18 to 28 carbon atoms. Mixtures of olefins are preferred in either case, so as to give a spread of alkyl group sizes.

The aromatics that are alkylated can have about 1 to 3 benzene rings, which in turn can have 0 to 3 alkyl groups, or other substituents, per ring. Alkyl substituents may contain 1 to 20 carbon atoms. Other substituents include OR, $NR_2$, F, Cl, Br, $NO_2$ and esters, i.e., COOR. Examples of such aromatic materials include benzene, naphthalene, phenanthrene, ortho xylene, tertiary butyl benzene, diphenyl, diphenyl ether, chlorobenzene, m-diphenoxybenzene, triphenylmethane, nitrobenzene, dimethylaniline and octadecylbenzoate.

The preferred alkylated aromatic compounds used in this invention are alkylated diphenyl and alkylated diphenyl ether. R in the above can be alkyl of 1 to 20 carbon atoms, phenyl, or alkylated phenyl having 1 to 2 alkyl groups totalling 1 to 20 carbon atoms.

In order to alkylate the aromatic compound with the olefinic material, i.e., alpha olefin or olefin dimer, any general procedure for alkylating aromatics with olefinic materials that is known to the art can be used. Usually, the alkylation can be carried out by reacting the olefinic material with the aromatic material in molar proportions of the former to the latter, of from 1:50 to 5:1, preferably 1:10 to 2:1. Normally the proportions used will depend upon the number of alkyl groups desired. This reaction can be conducted in the presence of a Friedel-Crafts catalyst, normally using a solvent, by reacting the olefin or dimer and the aromatic material at a temperature of about 0° to 150° C., preferably 20° to 100° C. for about 0.1 to 10, preferably 0.2 to 4 hours.

The Friedel-Crafts catalysts will normally be used on the basis of about 0.001 to 0.1, preferably 0.01 to 0.05, molar proportions of catalyst per mole of the aromatic material. Examples of specific suitable catalysts include $AlCl_3$, $FeCl_3$, $AlBr_3$, $BF_3$, $SnCl_4$ and $SbF_5$, and strong protonic acids such as $H_2SO_4$ or HF.

The reaction will usually be carried out in the presence of an inert solvent, preferably a volatile solvent such as paraffins, isoparaffins, naphthenes, methylene chloride, or nitromethane. When monoalkylation is desired, an excess of the aromatic compound being alkylated is generally the preferred solvent. In some cases it is also possible to carry out the reaction in the absence of added solvent.

A convenient way of performing the alkylation is by dissolving the olefinic material in a solvent and continuously adding the resulting solution to the reaction vessel containing more solvent, the aromatic and the catalyst. Additional catalyst can be added during the course of the reaction, or periodically during the reaction, so as to generally keep the amount of olefinic reactant and the amount of catalyst roughly the same during the course of the reaction. The alkylation can be carried out so as to attach about 1 to 5 molar proportions, preferably 1 to 3 molar proportions, of the olefin or olefin dimer per molar proportion of the aromatic material reacted.

Normally the amount of solvent will be about 0 to 95, perferably 50 to 90 parts by weight based upon 100 parts by weight of the aromatic being alkylated. Alternatively to using a volatile solvent, a mineral lubricating oil can be used, preferably one free of aromatic hydrocarbons, such as a white oil, so as not to interact with the reactants. When using an oil as solvent, the reaction product can be simply left in the oil to thereby form a concentrate for later use as an oil additive. However, if desired, the resulting product can be purified removing the catalyst by neutralization with caustic and then filtering and distilling off the solvent.

In some cases it will be advantageous to first hydrochlorinate the olefinic material in order to facilitate its reaction with the aromatic. This, in turn, can be done by saturating the olefin or dimer with dry hydrogen chloride gas, usually is the presence of a solvent such as ethyl ether. This reaction is usually carried out at moderate temperatures of about −50° to +50° C., preferably 0° to 30° C., by simply blowing the HCl gas through either the olefinic material per se or a solution of the olefin or dimer in a solvent, for example, 5 to 50 wt. % dimer dissolved in the solvent. The solvent, of course, will be one which will not react with the hydrochloric acid gas.

The synergistic additive combination of the invention may be used alone as the sole oil additive, or in combination with other oil additives such as other pour depressants or dewaxing aids, corrosion inhibitors, antioxidants, and sludge inhibitors.

Preparation of Olefin Dimers

A dimer of a $C_{18}$ alpha olefin was prepared as follows: 75.8 g. (0.30 mole) of a commercial octadecene-1 consisting: of 93 wt. % octadecene-1, 0.7 wt. % of $C_{16}$ - olefin 1.3 wt. % $C_{20}$ alpha olefin, and 4.7 wt. % of a $C_{18}$ paraffin of Type III olefin, was added to a 250 ml. flask equipped with a reflux condenser and magnet for stirring. 2.13 g. (0.015 mole) of a pure aluminum diisobutyl hydride was added as catalyst. Nitrogen was bubbled through the flask to exclude air, while heating in an oil bath at 160° C. for 24 hours. Following this, the flask was cooled to 100° C. and then 100 ml. of normal-heptane ($C_7$) was slowly added to the flask. This was followed by the addition of 10 ml. of water to hydrolyze the catalyst and convert it into a hydrocarbon insoluble product. The flask was maintained at 100° C. for about 15 minutes while stirring, following which the contents of the flask were filtered to remove insoluble catalyst. The solution was then stripped in a short path still to a vapor temperature of 200° C. at 0.2 mm. mercury pressure.

The bottoms of 54.3 g. was obtained as a white solid material having a melting point of about 44.5 to about 45.5° C. Analysis showed said material was 93.2 wt. % $C_{36}H_{72}$ having predominantly the structure:

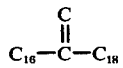

wherein said $C_{16}$ and $C_{18}$ were straight chain $C_{16}$ and $C_{18}$ alkyl groups. This product is hereinafter abbreviated as $(C_{18})_2$. The bottoms material had a molecular weight of 498 which was in close agreement to the calculated molecular weight of 504.

The aforesaid analysis showed said bottoms consisted on a weight percent basis of 0.8% $C_{18}$; 0.2% $C_{20}$; 0.2% of $C_{22}$; 1.1% of $C_{34}$; 93.2% of $C_{36}$; 3.0% of $C_{38}$; and 1.5% of $C_{54}$.

Other dimers were prepared from various alpha olefin feeds in the same general manner.

The reaction conditions and olefin feeds used to prepare the dimers are summarized in the following Table I. The products were of high purity, that is at least 97 wt. % dimer, of which at least 89 wt. % of the products prepared was the dimer of the carbon number indicated and the remainder was analogous dimers derived from the other olefin impurities in the feed.

TABLE I

| Dimer | Preparation of Olefin Dimers 1 | 2 | 3 | 4 | 5 |
|---|---|---|---|---|---|
| g. Olefin | 75.8 $C_{18}$ | 56.0 $C_{18-24}$ | 106.0 $C_{19}$ | 84.2 $C_{20}$ | 89.8 $C_{16}$ |
| g. Al(i Bu)$_2$H | 2.13 | 1.42 | 4.26 | 2.13 | 2.84 |
| Temp., ° C. | 160 | 170 | 160 | 160 | 160 |
| Time, hr. | 24 | 24 | 24 | 24 | 24 |
| Product | $(C_{18})_2$ | $(C_{18-24})_2$ | $(C_{19})_2$ | $(C_{20})_2$ | $(C_{16})_2$ |

Note: The $C_{18-24}$ olefin consisted of a mixture of even-numbered alpha olefins having a number average molecular weight of 327 and a melting point range of 79–85° F.

Polymerized $C_{19}$ Dimer

This additive was prepared by dimerization of $C_{19}$ olefin followed by polymerization.

10.7 g. of the $(C_{19})_2$ product of Dimer 3 (equivalent to 0.02 mole) and 50 ml. of normal heptane were added to a 250 ml. 2-neck flask equipped with a thermometer and reflux condenser. The resulting mixture of heptane and olefin dimer was heated sufficiently to dissolve the dimer in the heptane and then 50 ml. of methylene chloride and one drop of t-butyl chloride were added as co-catalyst for the aluminum chloride. The flask was then cooled until the olefin dimer began crystallizing from the solution. Then 0.133 g. of aluminum trichloride was added as catalyst and the reaction mixture was maintained for about 4 hours at temperature in the range of about 8° C. to about 12° C. 100 ml. of isopropanol was then added for the purpose of quenching and extracting catalyst residues, whereupon the yellow color of the reaction mixture became white. The mixture was filtered through filter paper. The precipitate that was recovered from the filtration was the product and it had a number average molecular weight by Vapor Pressure Osmometry (VPO) of 809. The product has an average carbon content of 57.7 carbons per molecule, which calculates to about 48.1 wt. % of unpolymerized $C_{38}$ and 51.9 wt. % of $C_{76}$ which is material of the formula:

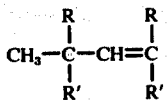

wherein R is a $C_{17}$ straight chain alkyl group and R′ is a $C_{19}$ straight chain alkyl group.

Alkylation of Diphenyl Ether and Diphenyl

Alkylate M

Alkylation of diphenyl ether with Dimer 5, i.e., dimerized $C_{16}$ alpha olefin, (also preferred to as $C_{32}$ dimer) was carried out as follows: To a 200 ml. 3-neck flask equipped with a reflux condenser with nitrogen sweep, thermometer, dropping funnel and magnetic stirrer, were charged 100 ml. of diphenyl ether and 1.08 g. of aluminum chloride (0.008 molar equivalent) dissolved in 10 ml. of nitromethane. Then, through the dropping funnel was added dropwise to the above solution, over a period of about 2 hours while maintaining the flask at 26° C., a total of 17.95 g. (0.04 mole) of the $C_{32}$ dimer (Dimer 5) dissolved in 80 ml. of diphenyl ether. At the end of this 2 hour period, another 1.08 g. of aluminum trichloride was added.

The reaction mixture was then heated for an additional 2 hours at 26° C., and then 10 ml. of $H_2O$ was added and the mixture was transferred into a separatory funnel where 100 ml. of normal heptane was added. The product was washed twice with dilute aqueous potassium carbonate ($K_2CO_3$) and once with $H_2O$ and then dried over $K_2CO_3$. The resulting material was stripped at a pot temperature of about 151° C. under about 0.03 mm. Hg. pressure to give 23.1 g. of bottoms which was a light yellow liquid. The theoretical yield was 24.75 g. The melting point of the material was about 10.5° C. A gel chromatography analysis indicated that the product contained about 14 wt. % of unreacted $C_{32}$ dimer, about 85 wt. % of the diphenyl ether alkylated with the dimerized $C_{16}$ alpha olefin and about 1% of dialkylate, i.e., diphenyl ether with two $C_{32}$ groups per molecule.

Alkylate N

Employing the procedure for the preparation of alkylate M, 100 ml. of diphenyl ether was alkykated with 39.2 g. (about 0.08 mole) of commercial mixed $C_{24}$-$C_{28}$ alpha olefins. Gas chromatographic analysis of the olefin feed showed 87% $C_{24}$-$C_{28}$ alpha olefins and 13% $C_{30}$-$C_{50}$ alpha olefins. In this preparation a total of only 1.08 g. $AlCl_3$ was used, and the reaction was run 4 hours at 25° C. after olefin addition, then the mixture was heated to 50° C. for 1 hour. After washing out catalyst residues, the product was stripped at 0.07 mm pressure to a pot temperature of 235° C. yielding 51.0 g. bottoms (calc'd = 52.8 g.). The product was predominantly monoalkylate with smaller amounts of unreacted olefins, dialkylate and higher products. The member average molecular weight was 591.

Alkylate O (dialkylate)

Dialkylation of diphenyl ether was mixed $C_{24-28}$ olefins (same feed as for alkylate N) was conducted as follows: To a 100 ml. flask were added 20 ml. orthodichlorobenzene, 3.4 g. (0.02 mole) diphenylether and 0.266 g. $AlCl_3$ (0.002 mole). A solution of 20 g. $C_{24-28}$ olefins in 40 ml. n-heptane was added rapidly at 25° C. The mixture was stirred 2 hours under reduced pressure (water aspirator pump); then the reaction was terminated by adding aqueous NaOH + methanol. The aqueous layer was separated an the hydrocarbon layer was washed successively by water, dilute HCl and twice more with water. After being dried over $K_2CO_3$, the product was filtered warm through Hyflo and stripped at 0.08 mm to a pot temperature of 235° C. Yield was 16.5 g., the product having a number average molecular weight of 910.

Alkylate P (dialkylate via tertiary chloride)

The tertiary chloride of dimerized $C_{19}$ alpha olefin (Dimer 3, described supra) was prepared as follows:

A one liter 2-neck flask equipped with a magnetic stirrer, reflux condenser, thermometer and gas inlet bubbler was charged with 46 g. of the dimerized $C_{19}$ alpha olefin (0.0863 mole), and 200 ml. of ethyl ether. The resulting mixture was then cooled until crystals appeared while saturating with HCl gas being charged through the gas inlet bubbler. At 25° C. the mixture turned cloudy and a small amount of solid began to come out of the solution. The temperature was maintained in the general range of about 16° to 30° C. for about another 45 minutes and then 2 ml. of triethyl amine was added as catalyst. The reaction was then continued for about another 3-½ hours, following which the mixture was allowed to warm up to room temperature and to remain over the weekend at room temperature in the presence of HCl. The material was then swept with nitrogen gas and some of the ether in the container along with some of the HCl was stripped off with a water aspirator pump. The remaining material was then transferred into a flask and vacuum dried at 50° C. to give 51.7 g. of material which was then dissolved in n-heptane, washed once with very dilute HCl and twice with water. The material was then dried over $K_2CO_3$ and vacuum stripped in a rotary evaporator at about 30° C. under vacuum from a water pump to finally give 49.3 g. of $C_{38}$ tertiary chloride (abbreviated t-$C_{38}$ Cl) as opposed to a theoretical yield of 49.29 g.

Dialkylation of diphenyl with the tertiary chloride of $C_{19}$ dimer (t-$C_{38}$ Cl) was carried out as follows: To a mixture of 1.54 g. (0.01 mole) diphenyl, 0.266 g. (0.002 mole) $AlCl_3$ and 20 ml. n-heptane there was added 10.7 g. t-$C_{38}$ Cl (0.02 mole) in 40 ml. n-heptane. Pressure was reduced gradually by means of a water pump to 68 mm during 2 hours at 23-26° C. Catalyst was killed and extracted as described in the preparation of alkylate O, and the product was stripped at 0.01 mm to a pot temperature of 215° C. Yield was 11.1 g. Some unreacted feed and monoalkylate were also present in the product.

Alkylation of Benzene

The tertiary chloride of dimerized $C_{19}$ alpha olefin was also used to alkylate benzene as follows: To a flask of the type described for preparing the tertiary chloride, there were added 2.66 g. (0.002 mole) of aluminum trichloride, 0.78 g. (0.01 mole) of benzene dried over $CaH_1$, and 20 ml. of normal heptane. Then there was added through the condenser 10.7 g. (0.02 mole) of the aforesaid $C_{38}$ tertiary-chloride dissolved in 40 ml. of normal heptane. After a period of about 1 hour and 5 minutes at 25° C. to 28° C., the heat was turned on and the material was heated to 50° C. for a few minutes whereupon a deep amber color formed. The pressure was reduced to 150–60 mm. Hg. for 30 minutes, and then the flask was allowed to cool to 25°–27° C. 10.46 g. of product was obtained which an infrared analysis showed to be mainly paradialkylate with some monoalkylate.

Examples of Fuel Blends and Testing Thereof

Additive blends were prepared using as the base fuel a diesel fuel comprising 45 percent catalytically cracked distillates and 55% virgin distillates. The diesel fuel had an atmospheric boiling range of 396° to 646° F., a cloud point of +2° F. and an API gravity of 34.2 at 60° F. In these diesel fuel blends the succinamic acid additive, Component A, was the reaction product of equal moles of dihydrogenated tallow amine and alkenyl succinic anhydride wherein the alkenyl groups were derived from isomerized $C_{15}$-$C_{20}$ cracked wax olefins, as described in Example 1 of U.S. Pat. No. 3,444,082. component B in the blends consisted of one of the alkylates of diphenyl ether or of diphenyl described below.

The diesel fuel alone and each of the blends containing the additives were subjected to a low temperature filterability test in which 200 ml. of the fuel is cooled at a rate of 4° F. per hour until a temperature of either −5° F. or −10° F. is reached, these being the temperatures at which the flow test is conducted. The cold diesel fuel is then caused to flow through a 325 mesh screen of 1 centimeter diameter using an applied vacuum of 4 of mercury, and the percentage of fuel flowing through the screen in 25 seconds is determined.

The compositions of the diesel fuel blends tested and the test results obtained are given in Table II which follows:

TABLE II

| Blend Tested Diesel Fuel Plus Indicated Weight Percentage of Additive | Percent Diesel Fuel Through 325 Mesh Screen in 25 Seconds at −5° F. | −10° F. |
|---|---|---|
| No Additive | 0 | 0 |
| 0.1 % Component A | 20 | 0 |
| 0.3 $C_{24}$–$C_{28}$ alkylate of diphenyl ether (N) | 3 | 0 |
| 0.3 $C_{24}$–$C_{28}$ dialkylate of diphenyl ether (O) | 0 | 0 |
| 0.2 $C_{38}$ dialkylate of diphenyl (P) | 5 | 0 |
| 0.05 A + 0.1 N | 100 | 100 |
| 0.05 A + 0.1 O | 100 | 100 |
| 0.05 A + 0.1 P | 100 | 100 |

It will be noted that the succinamic acid additive (Component A) improved low temperature flow properties to some extent at −5° F. but not at −10° F. There was a slight improvement in flow at −5° F with the alkylate of diphenyl ether and with the dialkylate of diphenyl ether, but none of the alkylates improved flow at −10° F. On the other hand, combinations of the alkylated aromatic materials with the succinamic acid additive gave very satisfactory improvement in low temperature flow at both test temperatures, even though the concentrations of the additives were considerably less in the combinations than in the test where each additive was used alone.

What is claimed is:

1. A petroleum middle distillate fuel which has been improved with respect to its low temperature flow properties by adding thereto a minor amount of a flow improving additive combination of synergistic proportions of:

A. a hydrocarbyl succinamic acid material of the formula:

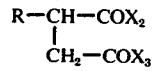

wherein R is a straight chain aliphatic hydrocarbon having from 0 to 1 site of olefinic unsaturation and from 14 to 40 carbon atoms and attached at a secondary carbon atom to the succinyl group; one of $X^2$ and $X^3$ is $—NYY^1$, wherein Y and $Y^1$ are aliphatic hydrocarbyl groups of from 14 to 28 carbon atoms, the other of $X^2$ and $X^3$ is of the formula:

$$—OH(NHY^2Y^3)_n$$

wherein $n$ varies from 0 to 1, $Y^2$ and $Y^3$ are hydrogen, aliphatic hydrocarbon of from 1 to 30 carbon atoms or oxyaliphatic hydrocarbon of from 1 to 30 carbon atoms, and may be taken together with the nitrogen to which they are attached to form a heterocyclic ring of from 5 to 7 annular members; and B. a derivative of an alpha olefin selected from the group consisting of:

1. a dimer of an alpha olefin that has from 16 to 40 carbon atoms;
2. a polymer of dimer (1);
3. an aromatic compound that has been alkylated with dimer (1); and
4. an aromatic compound that has been alkylated with an alpha olefin having from 16 to 50 carbon atoms;

said aromatic compound that is alkylated under (3) or (4) being selected from aromatic hydrocarbons having from 1 to 3 benzene rings, from 0 to 3 alkyl groups of from 1 to 20 carbon atoms each, and from 0 to 3 other substituents per ring, said other substituents being selected from the group consisting of COOR, OR, $NR_2$, F, Cl, Br and $NO_2$ wherein R is alkyl of 1 to 20 carbon atoms, phenyl or alkylated phenyl having 1 to 2 alkyl groups totalling 1 to 20 carbon atoms;

the relative weight ratios of the additives in the combination ranging from 0.01 to 10 parts by weight of B per part by weight of A.

2. The fuel composition of claim 1 wherein B is alkylated diphenyl.

3. The fuel composition of claim 1 wherein B is alkylated diphenyl ether.

4. The fuel composition of claim 1 wherein B is diphenyl alkylated with the dimer of $C_{19}$ alpha olefin.

5. The fuel composition of claim 1 wherein B is diphenyl ether alkylated with a mixture of predominantly $C_{24}$-$C_{28}$ alpha olefins.

6. The fuel composition of claim 1 wherein B is a dimer of an alpha olefin that has from 16 to 34 carbon atoms.

7. The fuel composition of claim 1 wherein B is alkyl diphenyl or alkyl diphenyl ether having from 1 to 5 alkyl groups per diphenyl group or diphenyl ether group.

8. The fuel composition of claim 1 wherein A is a hydrocarbyl succinamic acid material in which R represents hydrocarbyl groups of mixed $C_{15}$-$C_{20}$ cracked wax olefins.

9. The fuel composition of claim 1 wherein in Component A, the said —$NYY^1$ group is derived from amines selected from the group consisting of:

a. di(hydrogenated tallow) amine ($C_{16}$-$C_{18}$);
b. di(behenyl-arachidyl) amine ($C_{22}$-$C_{24}$);
c. mixtures of the foregoing.

10. The fuel composition of claim 1 wherein the additive combination is present in a concentration of between about 0.01 and about 3 percent by weight, based on the fuel composition.

11. The fuel composition of claim 1 wherein the middle distillate fuel is a diesel fuel.

12. The fuel composition of claim 1 wherein the middle distillate fuel is a heating oil.

13. A synergistic additive combination that has the property of improving the low temperature filterability of a petroleum distillate fuel when added thereto which comprises:

A. a hydrocarbyl succinamic acid material of the formula:

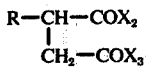

wherein R is a straight chain aliphatic hydrocarbon having from 0 to 1 site of olefinic unsaturation and from 14 to 40 carbon atoms and attached at a secondary carbon atom to the succinyl group; one of $X^2$ and $X^3$ is —$NYY^1$, wherein Y and $Y^1$ are aliphatic hydrocarbyl groups of from 14 to 28 carbon atoms, the other of $X^2$ and $X^3$ is of the formula:

$$-OH(NHY^2Y^3)_n$$

wherein $n$ varies from 0 to 1, $Y^2$ and $Y^3$ are hydrogen, aliphatic hydrocarbon of from 1 to 30 carbon atoms or oxyaliphatic hydrocarbon of from 1 to 30 carbon atoms, and may be taken together with the nitrogen to which they are attached to form a heterocyclic ring of from 5 to 7 annular members;

B. a derivative of an alpha olefin selected from the group consisting of:
1. a dimer of an alpha olefin that has from 16 to 40 carbon atoms;
2. a polymer of dimer (1);
3. an aromatic compound that has been alkylated with dimer (1); and
4. an aromatic compound that has been alkylated with an alpha olefin having from 16 to 50 carbon atoms;

said aromatic compound that is alkylated under (3) or (4) being selected from aromatic hydrocarbons having from 1 to 3 benzene rings, from 0 to 3 alkyl groups of from 1 to 20 carbon atoms each, and from 0 to 3 other substituents per ring, said other substituents being selected from the group consisting of COOR, OR, $NR_2$, F, Cl, Br and $NO_2$ wherein R is alkyl of 1 to 20 carbon atoms, phenyl or alkylated phenyl having 1 to 2 alkyl groups totalling 1 to 20 carbon atoms;

the relative weight ratios of the additives in the combination ranging from 0.01 to 10 parts by weight of B per part by weight of A.

14. An additive concentrate comprising about 3 to 60 wt. % of the additive combination of claim 13 in a hydrocarbon oil.

* * * * *